US011587725B2

(12) United States Patent
Shiokawa et al.

(10) Patent No.: US 11,587,725 B2
(45) Date of Patent: Feb. 21, 2023

(54) INDUCTOR COMPONENT

(71) Applicant: Murata Manufacturing Co., Ltd., Kyoto-fu (JP)

(72) Inventors: Noboru Shiokawa, Nagaokakyo (JP); Takuya Izumisawa, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 429 days.

(21) Appl. No.: 16/829,969

(22) Filed: Mar. 25, 2020

(65) Prior Publication Data

US 2020/0312537 A1 Oct. 1, 2020

(30) Foreign Application Priority Data

Mar. 26, 2019 (JP) ..... JP2019-059026

(51) Int. Cl.

| | |
|---|---|
| ***H01F 27/24*** | (2006.01) |
| ***H01F 27/29*** | (2006.01) |
| ***H01F 27/28*** | (2006.01) |
| ***H01F 27/34*** | (2006.01) |

(52) U.S. Cl.

CPC ..... *H01F 27/34* (2013.01); *H01F 27/24* (2013.01); *H01F 27/2823* (2013.01); *H01F 27/29* (2013.01)

(58) Field of Classification Search

CPC ..... H01F 27/34; H01F 27/24; H01F 27/2823; H01F 27/29; H01F 17/045; H01F 27/006;

(Continued)

(56) References Cited

U.S. PATENT DOCUMENTS

2016/0315388 A1* 10/2016 Imai ..... H01Q 7/08
2017/0288626 A1* 10/2017 Kobayashi ..... H03H 1/00

(Continued)

FOREIGN PATENT DOCUMENTS

CN 105720371 A 6/2016
CN 105900286 A 8/2016

(Continued)

OTHER PUBLICATIONS

An Office Action; "Notice of Reasons for Refusal," mailed by the Japanese Patent Office dated Nov. 2, 2021, which corresponds to Japanese Patent Application No. 2019-059026 and is related to U.S. Appl. No. 16/829,969 with English translation.

(Continued)

*Primary Examiner* — Lincoln D Donovan
*Assistant Examiner* — Alex W Lam
(74) *Attorney, Agent, or Firm* — Studebaker & Brackett PC

(57) ABSTRACT

An inductor component includes a core including a winding core portion, a first collar disposed at a first end of the winding core portion in an axial direction, and a second collar disposed at a second end of the winding core portion in the axial direction. The inductor component further includes a first electrode disposed on the first collar; a second electrode disposed on the second collar; and a wire electrically connected to the first electrode and the second electrode and wound around the winding core portion in such a manner as to form a plurality of wound regions arranged along the axial direction of the winding core portion. A distance between adjacent ones of the wound regions is greater than a winding pitch of the wire in each of the wound regions.

21 Claims, 5 Drawing Sheets

(58) Field of Classification Search
CPC ..... H01F 17/04; H01F 27/255; H01F 27/28; H01F 27/292; H01F 3/10; H01F 19/08; H01F 27/2828
See application file for complete search history.

(56) References Cited

U.S. PATENT DOCUMENTS

| | | | | |
|---|---|---|---|---|
| 2018/0097497 | A1* | 4/2018 | Kobayashi | H01F 19/08 |
| 2018/0247751 | A1 | 8/2018 | Noya et al. | |
| 2019/0228901 | A1* | 7/2019 | Asai | H01F 27/006 |

FOREIGN PATENT DOCUMENTS

| | | | |
|---|---|---|---|
| JP | 2004-146683 | A | 5/2004 |
| JP | 2005-175965 | A | 6/2005 |
| JP | 2007-288345 | A | 11/2007 |
| JP | 2010-016492 | A | 1/2010 |
| JP | 2013-219088 | A | 10/2013 |
| JP | 2016-134848 | A | 7/2016 |
| JP | 2016-139713 | A | 8/2016 |
| JP | 2017-085180 | A | 5/2017 |
| JP | 2018-142644 | A | 9/2018 |

OTHER PUBLICATIONS

An Office Action mailed by China National Intellectual Property Administration dated Jul. 5, 2021 which corresponds to Chinese Patent Application No. 202010217244.0 and is related to U.S. Appl. No. 16/829,969 with English language translation.

* cited by examiner

INDUCTOR COMPONENT

CROSS-REFERENCE TO RELATED APPLICATION

This application claims benefit of priority to Japanese Patent Application No. 2019-059026, filed Mar. 26, 2019, the entire content of which is incorporated herein by reference.

BACKGROUND

Technical Field

The present disclosure relates to an inductor component.

Background Art

An inductor component is described, for example, in Japanese Unexamined Patent Application Publication No. 2013-219088. The inductor component includes a core including a winding core portion, a first collar, and a second collar; a first electrode and a second electrode disposed on the first collar and the second collar, respectively; and a wire electrically connected to the first electrode and the second electrode and wound around the winding core portion. The wire wound around the winding core portion forms a plurality of wound regions arranged along the axial direction of the winding core portion. The wound regions include a plurality of closely wound portions where the wire is closely wound, and a loosely wound portion where the wire is loosely wound. The loosely wound portion is interposed between the closely wound portions.

When the number of turns in the loosely wound portion is made greater or less than the number of turns in each closely wound portion, the inductor component of the related art focuses only on the setting of an inductance (L) value at frequencies not exceeding the self-resonant frequency. Since variation in the attenuation characteristics of S21 is not controlled in the frequency band beyond the self-resonant frequency, the attenuation characteristics in the frequency band beyond the self-resonant frequency may be degraded. Additionally, when high-Q coils are connected in series for attenuation, anti-resonance (ripple) occurs between resonant frequencies of the inductors. This often makes it difficult to obtain wide-band attenuation characteristics.

Currently, attenuation is possible only in the low band (or LB from about 600 MHz to about 1 GHz), and in the Wi-Fi bands from about 2.4 GHz to about 2.6 GHz and from about 5 GHz to about 6 GHz. However, attenuation in the band from about 1.5 GHz to about 2.5 GHz and the band from about 3 GHz to about 5 GHz, as well as in the frequency bands described above, will be required in the future. Therefore, it is becoming increasingly necessary for low-frequency signal lines, such as audio lines, to attenuate high-frequency signals in a wider band.

SUMMARY

Accordingly, the present disclosure provides an inductor component that can reduce instability of attenuation characteristics in the frequency band beyond the self-resonant frequency.

An inductor component according to an aspect of the present disclosure includes a core including a winding core portion, a first collar disposed at a first end of the winding core portion in an axial direction, and a second collar disposed at a second end of the winding core portion in the axial direction; a first electrode disposed on the first collar; a second electrode disposed on the second collar; and a wire electrically connected to the first electrode and the second electrode and wound around the winding core portion in such a manner as to form a plurality of wound regions arranged along the axial direction of the winding core portion. A distance between adjacent ones of the wound regions is greater than a winding pitch of the wire in each of the wound regions.

In the aspect described above, the distance between adjacent ones of the wound regions is greater than the winding pitch of the wire in each of the wound regions. By varying the distance between adjacent ones of the wound regions, therefore, the line-to-line capacitance (distributed capacitance (C) characteristic) between the wound regions (distributed inductance (L) characteristics) can be adjusted to set the anti-resonant frequency. This makes it possible to obtain high attenuation characteristics in a wide band, or to obtain attenuation characteristics with low ripple in a wide band. Instability of attenuation characteristics in the frequency band beyond the self-resonant frequency can thus be reduced.

In an embodiment of the inductor component, the core is a dielectric and is solid.

In this embodiment, where the core is a dielectric and is solid, it is possible to increase the core loss and decrease the quality factor (Q value). This can make the resonance less sharp and can widen the high-impedance frequency band.

In another embodiment of the inductor component, the core is made of a magnetic material.

In this embodiment, where the core is made of a magnetic material, it is possible to increase the core loss and decrease the Q value. This can make the resonance less sharp and can widen the high-impedance frequency band.

In another embodiment of the inductor component, the plurality of wound regions include a first wound region, a second wound region, and a third wound region arranged in order from the first collar toward the second collar. The number of turns of the wire in the second wound region differs from the number of turns of the wire in the first wound region or from the number of turns of the wire in the third wound region.

In this embodiment, the number of turns of the wire in the second wound region differs from the number of turns of the wire in the first wound region or from the number of turns of the wire in the third wound region. This allows adjustment of not only the line-to-line capacitance (distributed C characteristic) but also the distributed L characteristic by varying the number of turns, improves the degree of freedom in setting the anti-resonant frequency, and makes it possible to obtain high attenuation characteristics or attenuation characteristics with low ripple in a wider band.

In another embodiment of the inductor component, the number of turns of the wire in the second wound region is greater than the number of turns of the wire in the first wound region and the number of turns of the wire in the third wound region.

This embodiment allows the anti-resonant frequency to be set in a low band and allows high attenuation characteristics to be obtained in a wide band.

In another embodiment of the inductor component, the number of turns of the wire in the second wound region is at least about four greater than the number of turns of the wire in the first wound region and the number of turns of the wire in the third wound region.

This embodiment enables high attenuation characteristics to be maintained even at around 4 GHz (in the band from about 3 GHz to about 5 GHz).

In another embodiment of the inductor component, the number of turns of the wire in the second wound region is about seven, and the number of turns of the wire in the first wound region and the number of turns of the wire in the third wound region are about three.

This embodiment enables high attenuation characteristics to be maintained even at around 4 GHz (in the band from about 3 GHz to about 5 GHz).

In another embodiment of the inductor component, the number of turns of the wire in the second wound region is less than the number of turns of the wire in the first wound region and the number of turns of the wire in the third wound region.

This embodiment allows the anti-resonant frequency to be set in a high band and allows attenuation characteristics with low ripple to be obtained in a wide band.

In another embodiment of the inductor component, the number of turns of the wire in the second wound region is at least about three less than the number of turns of the wire in the first wound region and the number of turns of the wire in the third wound region.

This embodiment enables attenuation characteristics with low ripple to be ensured even at around 15 GHz (in the band from about 14 GHz to about 16 GHz).

In another embodiment of the inductor component, the number of turns of the wire in the second wound region is about one, and the number of turns of the wire in the first wound region and the number of turns of the wire in the third wound region are about four.

This embodiment enables attenuation characteristics with low ripple to be ensured even at around 15 GHz (in the band from about 14 GHz to about 16 GHz).

The inductor component according to the aspect of the present disclosure can reduce instability of attenuation characteristics in the frequency band beyond the self-resonant frequency.

Other features, elements, characteristics and advantages of the present disclosure will become more apparent from the following detailed description of preferred embodiments of the present disclosure with reference to the attached drawings.

DETAILED DESCRIPTION

Figure 1:
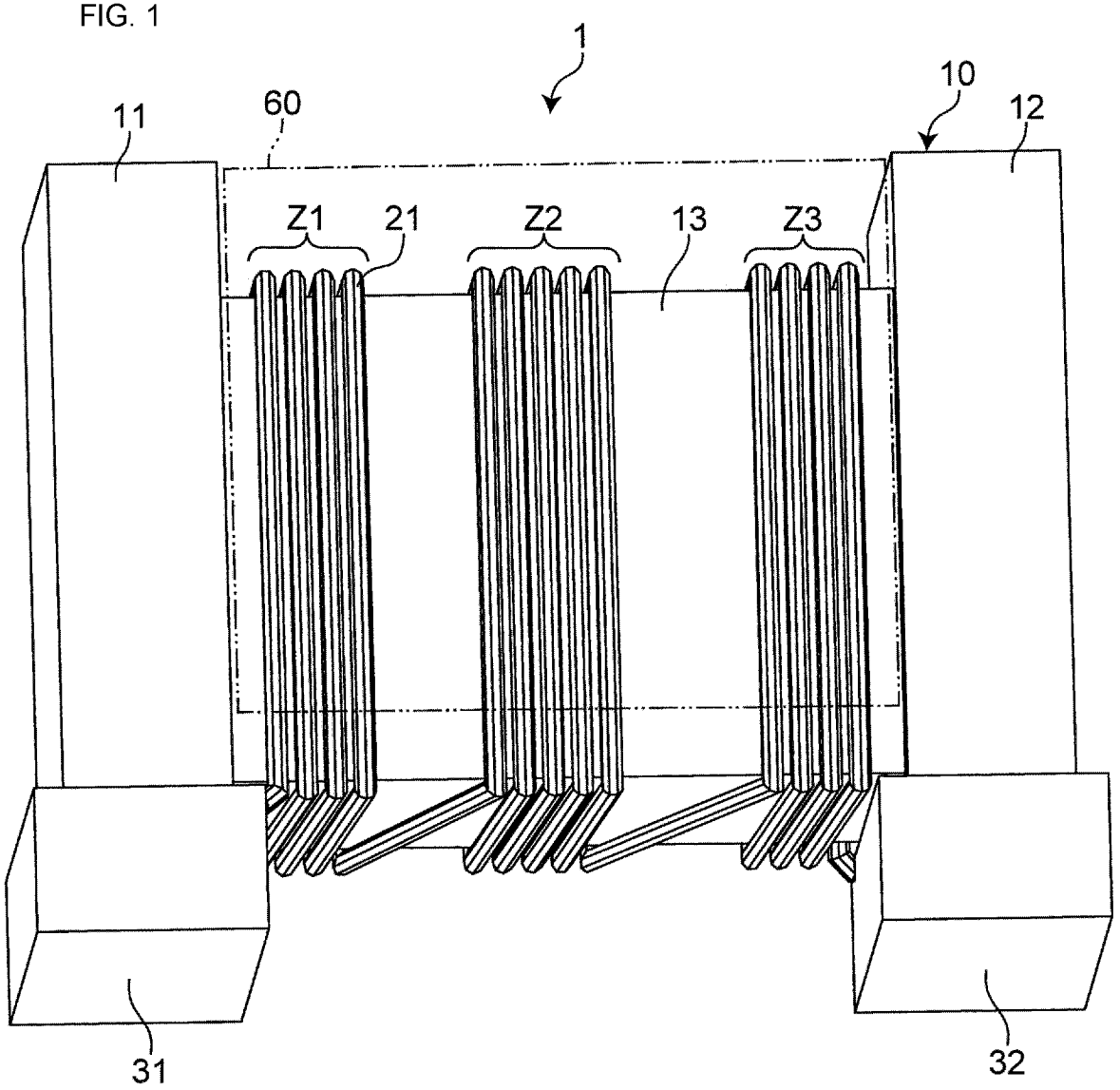
FIG. 1 is a perspective view illustrating a first embodiment of an inductor component, as viewed from the lower side.

An inductor component according to an aspect of the present disclosure will now be described in detail with reference to embodiments illustrated in the drawings. Note that some of the drawings are schematic and may not necessarily reflect actual dimensions or ratios.

First Embodiment

FIG. 1 is a perspective view illustrating a first embodiment of the inductor component, as viewed from the lower side. As illustrated in FIG. 1, an inductor component 1 includes a core 10, a first electrode 31 and a second electrode 32 disposed on the core 10, and a wire 21 wound around the core 10 and electrically connected to the first electrode 31 and the second electrode 32.

The core 10 includes a winding core portion 13 shaped to extend in a predetermined direction, a first collar 11 disposed at a first end of the winding core portion 13 in the predetermined direction and sticking out in a direction orthogonal to the predetermined direction, and a second collar 12 disposed at a second end of the winding core portion 13 in the predetermined direction and sticking out in the direction orthogonal to the predetermined direction. The winding core portion 13, the first collar 11, and the second collar 12 are each substantially in the shape of, for example, a rectangular parallelepiped. However, their shapes are not limited to this and they may have a different shape. For example, they may be substantially in the shape of a polygonal column other than a rectangular parallelepiped, such as a pentagonal or hexagonal column, or may be substantially in the shape of a circular cylinder. Some of their surfaces may be curved. In the following description, the predetermined direction in which the winding core portion 13 extends will be referred to as the axial direction of the winding core portion 13. The axial direction of the winding core portion 13 may be referred to as the direction of the winding axis of the wire 21.

The core 10 is preferably made of a magnetic material, such as sintered ferrite or molded resin containing magnetic powder, or may be made of a non-magnetic material, such as alumina, resin containing non-magnetic powder, or resin not containing any filler. The core 10 may be a sintered ceramic body, a non-crystalline solid such as glass, a crystal mainly composed of silicon (Si), or a dielectric such as a molded resin body. The core 10 is solid, but may be hollow (air-cored). In the following description, the lower surface of the core 10 is a surface mounted on a mounting board.

The first electrode 31 is disposed on the lower surface of the first collar 11, and the second electrode 32 is disposed on the lower surface of the second collar 12. The first electrode 31 and the second electrode 32 are formed, for example, by applying and baking a conductive paste containing silver (Ag) as a conductive component, or by sputtering a combination of nickel (Ni) and chromium (Cr), or a combination of Ni and copper (Cu). A plating film may also be formed as necessary. For example, the plating film may be made of metal, such as tin (Sn), Cu, or Ni, or may be made of an alloy of Ni and Sn. The plating film may have a multilayer structure, and two or more plating materials may be used.

The wire 21 is wound around the winding core portion 13 to form a coil. The wire 21 is an insulator-coated conductor that is obtained, for example, by coating a metal conductor, such as a copper conductor, with a resin coating, such as a polyurethane or polyamide-imide coating. The wire 21 is electrically connected at one end thereof to the first electrode 31, and electrically connected at the other end thereof to the second electrode 32. The wire 21 is connected to the first and second electrodes 31 and 32, for example, by thermal pressure bonding, brazing, or welding.

The inductor component 1 is mounted on the mounting board, with the lower surfaces of the first and second collars 11 and 12 facing the mounting board. When the inductor component 1 is mounted, the axial direction of the winding core portion 13 is parallel to the principal surface of the mounting board. That is, the inductor component 1 is of a horizontally wound type in which the winding axis of the wire 21 is parallel to the mounting board.

The inductor component 1 may further include a cover member 60 indicated by a double-dotted chain line in FIG. 1. The cover member 60 is disposed over the upper and side surfaces of the winding core portion 13 to cover the wire 21 wound around the winding core portion 13. The cover member 60 may be made, for example, of epoxy resin. The cover member 60 is configured, for example, to enable a suction nozzle to reliably suction when the inductor component 1 is mounted on the mounting board. Also, the cover member 60 protects the wire 21 from being scratched during suction by the suction nozzle. By using a magnetic material to form the cover member 60, the inductance value (L value) of the inductor component 1 can be improved. The cover member 60 is not necessarily required to be disposed over the upper and side surfaces of the winding core portion 13. For example, the cover member 60 may be disposed over the upper surface of the winding core portion 13, and is not necessarily required to cover the side surfaces of the winding core portion 13.

The wire 21 wound around the winding core portion 13 forms a plurality of wound regions Z1, Z2, and Z3 arranged along the axial direction of the winding core portion 13. Every distance between adjacent ones of the wound regions Z1, Z2, and Z3 is, or in other words, both the distance between the wound regions Z1 and Z2 and the distance between the wound regions Z2 and Z3 are, greater than the winding pitch of the wire 21 in each of the wound regions Z1, Z2, and Z3. The term "wound region" refers to a region where the wire 21 is wound around the winding core portion 13 in such a manner that the winding direction of the wire 21 forms a predetermined angle with respect to the axis of the winding core portion 13. In each area where the wire 21 connects adjacent ones of the wound regions Z1, Z2, and Z3, the angle formed by the winding direction of the wire 21 is greater than that in the wound regions Z1, Z2, and Z3.

Specifically, the plurality of wound regions Z1, Z2, and Z3 include the first wound region Z1, the second wound region Z2, and the third wound region Z3 arranged in order from the first collar 11 toward the second collar 12. The distance between the first wound region Z1 and the second wound region Z2 and the distance between the second wound region Z2 and the third wound region Z3 are both greater than the turning pitch of the wire 21 in each of the wound regions Z1, Z2, and Z3. The number of turns of the wire 21 in the second wound region Z2 differs from the number of turns of the wire 21 in the first wound region Z1 or from the number of turns of the wire 21 in the third wound region Z3. The number of turns of the wire 21 in the second wound region Z2 is greater than the number of turns of the wire 21 in the first wound region Z1 and the number of turns of the wire 21 in the third wound region Z3. The number of turns of the wire 21 in the first wound region Z1 may be equal to the number of turns of the wire 21 in the third wound region Z3.

In the inductor component 1, the distance between any adjacent ones of the wound regions Z1, Z2, and Z3 is greater than the winding pitch in each of the wound regions Z1, Z2, and Z3. By varying the distance between adjacent ones of the wound regions Z1, Z2, and Z3, therefore, the line-to-line capacitance (distributed C characteristic) between the wound regions (distributed L characteristics) can be adjusted to set the anti-resonant frequency. In the present embodiment, the number of turns of the wire 21 in the second wound region Z2 is greater than the number of turns of the wire 21 in the first wound region Z1 and the number of turns of the wire 21 in the third wound region Z3. Therefore, the anti-resonant frequency can be set in a low band and high attenuation characteristics can be obtained in a wide band. It is thus possible to reduce instability of attenuation characteristics in the frequency band beyond the self-resonant frequency.

Currently, attenuation is possible only in the LB (from about 600 MHz to about 1 GHz), and the Wi-Fi bands from about 2.4 GHz to about 2.6 GHz and from about 5 GHz to about 6 GHz. However, the attenuation in the band from about 1.5 GHz to about 2.5 GHz and the band from about 3 GHz to about 5 GHz, as well as in the frequency bands described above, will be required in the future. With the inductor component 1 described above, low-frequency signal lines, such as audio lines, can attenuate high-frequency signals in a wide band.

More specifically, the inductance component (L characteristic) and the capacitance component (C characteristic) of the entire coil contribute to the distribution of electromagnetic field of the inductor in the frequency band not exceeding the self-resonant frequency (SRF) of the inductor, and this produces a self-resonant point. At high frequencies, particularly in the frequency band beyond the SRF of the inductor, the inductor behaves like a distributed constant and the wound regions of the inductor wire are in a state where the inductance characteristic and the capacitance characteristic partially function. There are a plurality of anti-resonant frequencies beyond the SRF. When the anti-resonant frequency closest to the SRF is defined as a first anti-resonant frequency, the distribution of electromagnetic field between the SRF and the first anti-resonant frequency behaves in such a way as L characteristic+C characteristic+L characteristic.

In the inductor component 1, the C characteristic is the line-to-line capacitance of the wire forming the coil, and the C characteristic predominantly contributes to the anti-resonant frequency. Therefore, a desired anti-resonant frequency can be obtained by varying the number of turns in the second wound region Z2 in the middle. By designing the anti-resonant frequency to be lower than that in the structure of the related art, the high-impedance frequency band can be widened and good attenuation characteristics can be achieved.

In the inductor component 1, the number of turns of the wire 21 in the second wound region Z2 differs from the number of turns of the wire 21 in the first wound region Z1 and the number of turns of the wire 21 in the third wound region Z3. This allows adjustment of not only the line-to-line capacitance (distributed C characteristic) but also the distributed L characteristic by varying the number of turns, and improves the degree of freedom in setting the anti-resonant frequency.

Preferably, the number of turns of the wire 21 in the second wound region Z2 is at least about four greater than the number of turns of the wire 21 in the first wound region Z1 and the number of turns of the wire 21 in the third wound region Z3. More preferably, the number of turns of the wire 21 in the second wound region Z2 is about seven, and the number of turns of the wire 21 in the first wound region Z1 and the number of turns of the wire 21 in the third wound region Z3 are about three. This enables high attenuation characteristics to be maintained even at around 4 GHz (in the band from about 3 GHz to about 5 GHz).

The number of turns of the wire 21 in each wound region is considered one when the wire 21 is wound once around the winding core portion 13. As for the beginning or end of winding in each wound region, however, when the wire 21 is wound around half or more of the winding core portion 13, the number of turns is considered one. In the present embodiment, when the wire 21 is wound around the winding core portion 13 except the lower surface (i.e., wound around three surfaces of the winding core portion 13) at the beginning or end of winding in each wound region, the wire 21 is wound around half or more of the winding core portion 13 and thus, the number of turns can be considered one. That is, even when the number of turns of the wire 21 in the wound region is three as viewed from the lower surface of the winding core portion 13, if the number of turns is four as viewed from the other three surfaces of the winding core portion 13, then the number of turns of the wire 21 in the wound region is four. If the winding core portion 13 is substantially in the shape of a circular cylinder, the number of turns of the wire 21 can be considered one when the wire 21 is wound around half or more of the circumference. If the winding core portion 13 is substantially in the shape of a polygonal column, the number of turns of the wire 21 can be considered one when the wire 21 is wound around half or more of the outer periphery of a cross section orthogonal to the axial direction of the winding core portion 13.

Preferably, the core 10 is a dielectric and is solid. This can increase the core loss and decrease the Q value. This makes the resonance less sharp (i.e., makes the peak of impedance at the resonant point less sharp), makes the decrease in impedance less steep, and makes it difficult to identify the decrease in impedance between resonances. The high-impedance frequency band can thus be widened.

The core 10 is preferably made of a magnetic material, such as ferrite. This increases the core loss and decreases the Q value. It is thus possible to make the resonance less sharp and to widen the high-impedance frequency band.

Aside from using a solid dielectric core or a magnetic core, any configuration can be used as long as it increases the core loss. For example, the cover member 60 may contain magnetic powder to increase the core loss and decrease the Q value.

Examples of the first embodiment will now be described.

In a first example of the first embodiment, a hollow core of alumina was used. The core has a relative dielectric constant Er of about 100, a relative magnetic permeability μr of about 1, and a dissipation factor tan-δ of about 0. The number of turns in the second wound region Z2 is about five, and the number of turns in the first wound region Z1 and the number of turns in the third wound region Z3 are about four. In a comparative example, the wire was wound around the core about thirteen turns with equal pitches, and the core was not provided with more than one wound region.

Figure 2:
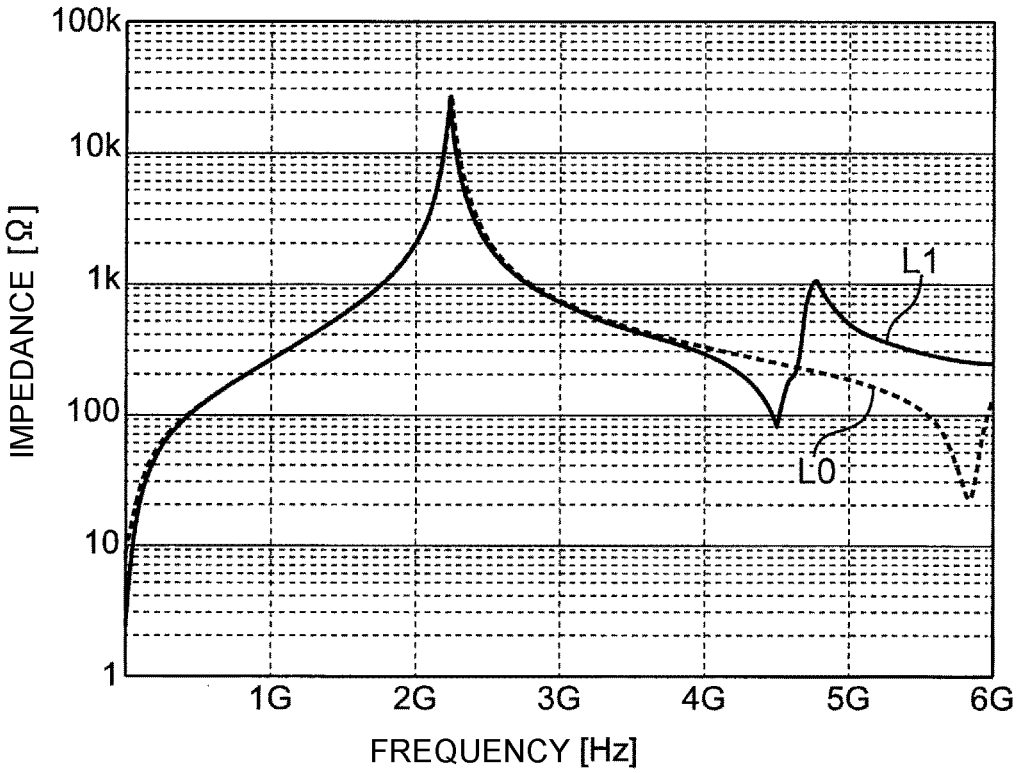
FIG. 2 is a graph showing a relation between frequency and impedance in a first example of the first embodiment and a comparative example.

FIG. 2 shows a relation between frequency and impedance in the first example of the first embodiment and the comparative example. In FIG. 2, the first example is represented by L1 and the comparative example is represented by L0. FIG. 2 shows that in the first example of the first embodiment, the anti-resonant frequency can be shifted to a frequency lower than that in the comparative example and the high-impedance frequency band can be widened.

In a second example of the first embodiment, a solid core of non-magnetic ferrite was used. The core has a relative dielectric constant Er of about 100, a relative magnetic permeability μr of about 1, and a dissipation factor tan-δ of about 2. The number of turns in the second wound region Z2 is about five, and the number of turns in the first wound region Z1 and the number of turns in the third wound region Z3 are about four. In a comparative example, the wire was wound around the core about thirteen turns with equal pitches, and the core was not provided with more than one wound region.

Figure 3:
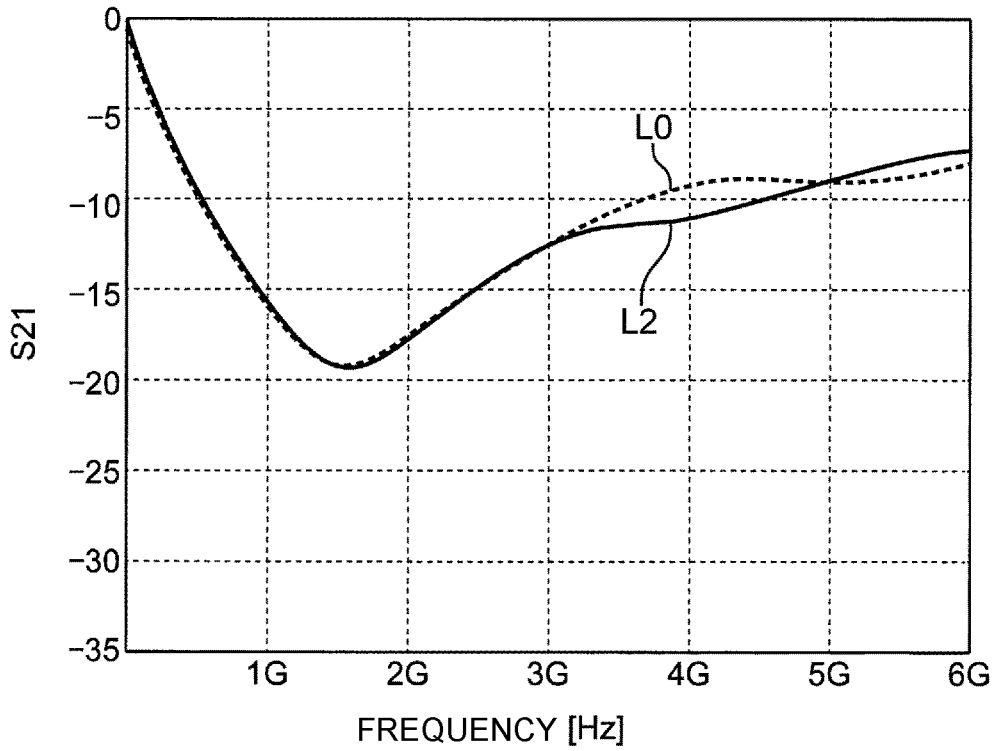
FIG. 3 is a graph showing a relation between frequency and S21 in a second example of the first embodiment and a comparative example.

FIG. 3 shows a relation between frequency and S21 in the second example of the first embodiment and the comparative example. In FIG. 3, the second example is represented by L2 and the comparative example is represented by L0. FIG. 3 shows that in the second example of the first embodiment, the Q value is lower and the resonance is less sharp than in the comparative example, and continuous high attenuation characteristics can be obtained in a wider band.

In third to sixth examples of the first embodiment, a hollow core of alumina was used. The core has a relative dielectric constant Er of about 100, a relative magnetic permeability μr of about 1, and a dissipation factor tan-δ of about 0. In the third example of the first embodiment, the number of turns in the second wound region Z2 is about one, and the number of turns in the first wound region Z1 and the number of turns in the third wound region Z3 are about eleven. In the fourth example of the first embodiment, the number of turns in the second wound region Z2 is about nine, and the number of turns in the first wound region Z1 and the number of turns in the third wound region Z3 are about two. In the fifth example of the first embodiment, the number of turns in the second wound region Z2 is about seven, and the number of turns in the first wound region Z1 and the number of turns in the third wound region Z3 are about three. In the sixth example of the first embodiment, the number of turns in the second wound region Z2 is about five, and the number of turns in the first wound region Z1 and the number of turns in the third wound region Z3 are about four. In a comparative example, the wire was wound around the core about thirteen turns with equal pitches, and the core was not provided with more than one wound region.

Figure 4A:
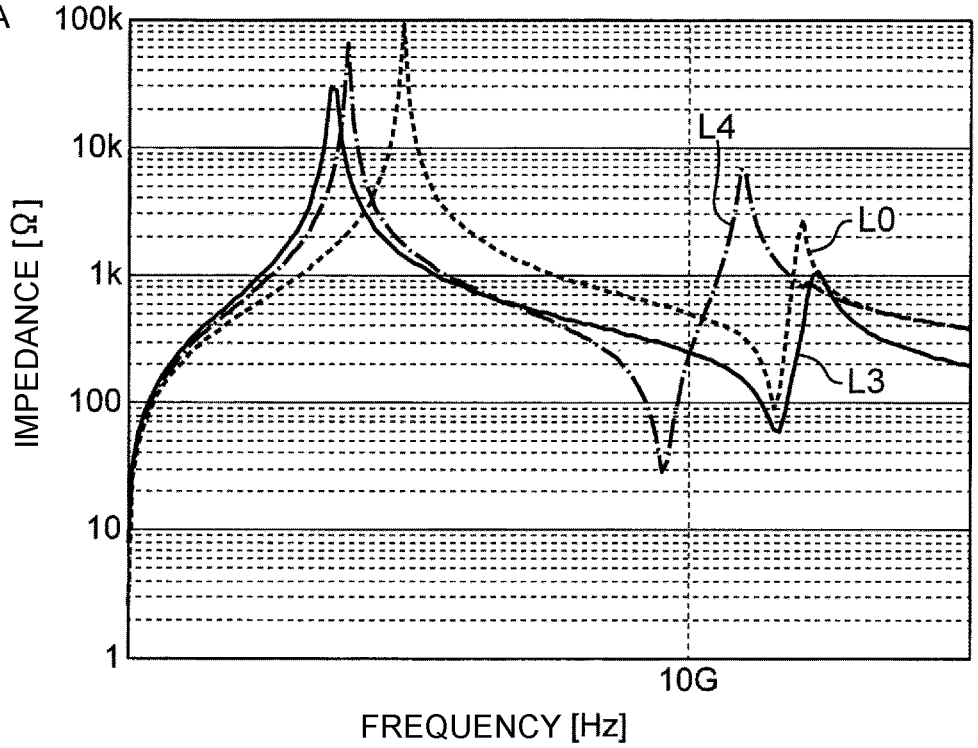
FIG. 4A is a graph showing a relation between frequency and impedance in third and fourth examples of the first embodiment and a comparative example.
Figure 4B:
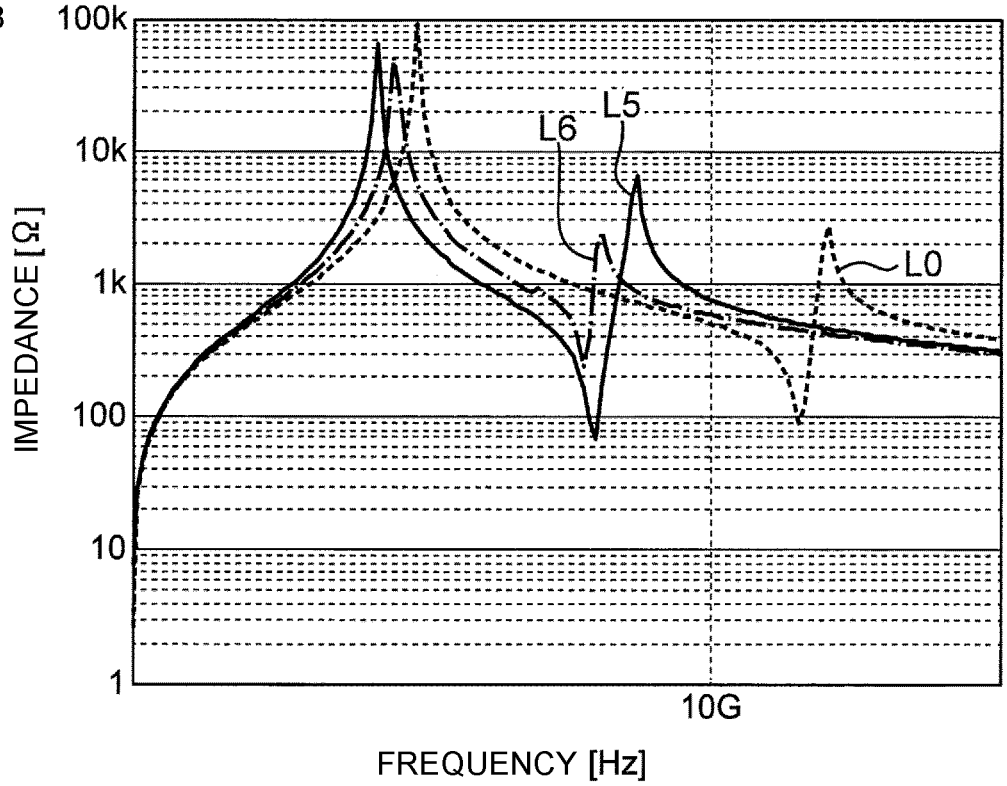
FIG. 4B is a graph showing a relation between frequency and impedance in fifth and sixth examples of the first embodiment and the comparative example.

FIG. 4A and FIG. 4B show a relation between frequency and impedance in the third to sixth examples of the first embodiment and the comparative example. In FIG. 4A and FIG. 4B, the third example is represented by L3, the fourth example is represented by L4, the fifth example is represented by L5, the sixth example is represented by L6, and the comparative example is represented by L0. FIG. 4A and FIG. 4B show that in the third to sixth examples of the first embodiment, the anti-resonant frequencies can be shifted to frequencies lower than that in the comparative example and the high-impedance frequency bands can be widened. Of the third to sixth examples of the first embodiment represented by L3 to L6, the sixth example has the highest effect, the fifth example has the second highest effect, the fourth example has the third highest effect, and the third example has the fourth highest effect.

Second Embodiment

Figure 5:
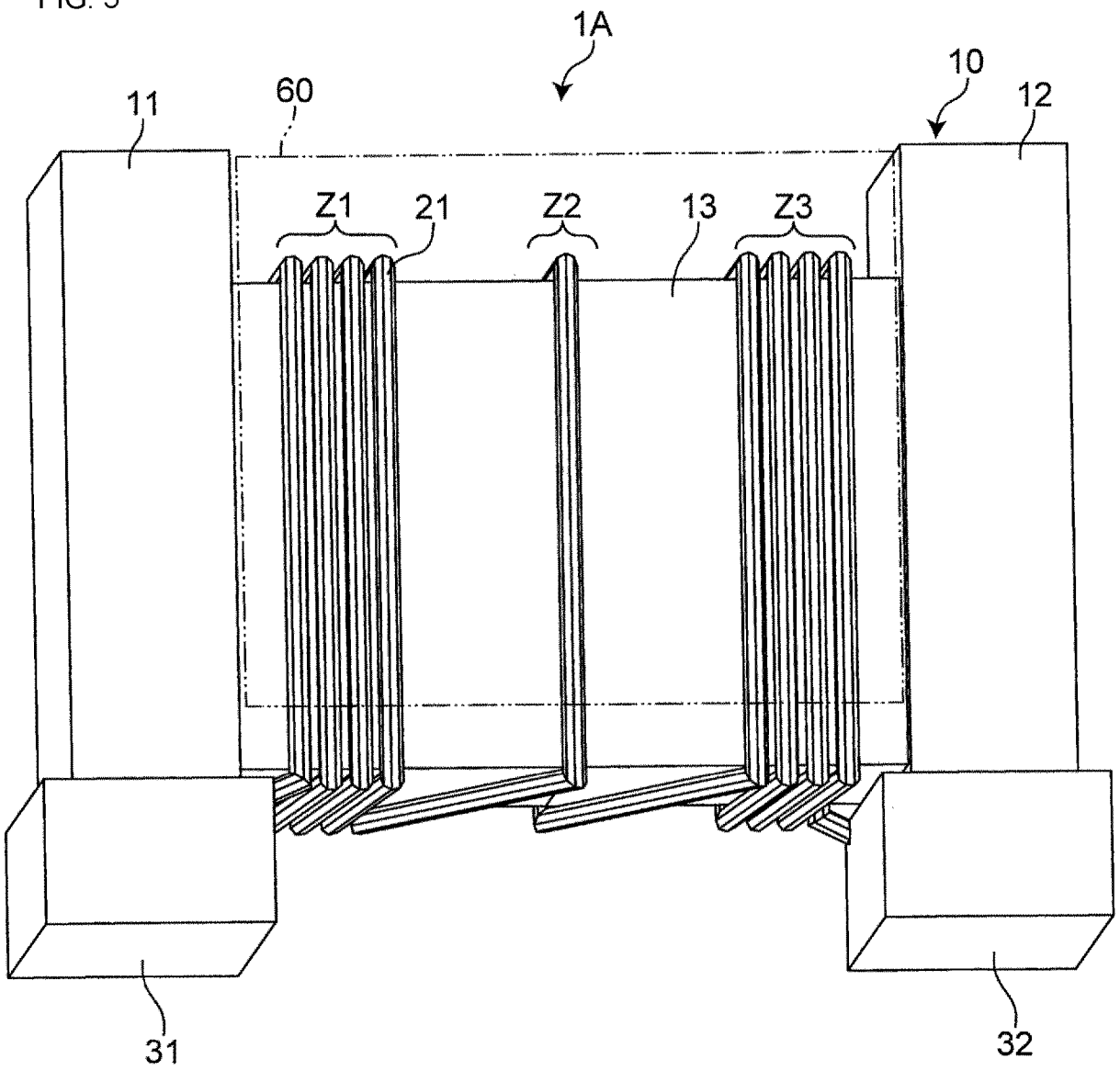
FIG. 5 is a perspective view illustrating a second embodiment of the inductor component, as viewed from the lower side.

FIG. 5 is a perspective view illustrating a second embodiment of the inductor component, as viewed from the lower side. The second embodiment differs from the first embodiment in the number of turns in the wound regions. This difference in configuration will now be described. The other configuration of the second embodiment is the same as that of the first embodiment, and its description will be omitted by using the same reference numerals as in the first embodiment.

As illustrated in FIG. 5, in an inductor component 1A of the second embodiment, the number of turns of the wire 21 in the second wound region Z2 is less than the number of turns of the wire 21 in the first wound region Z1 and the number of turns of the wire 21 in the third wound region Z3. With this configuration, the anti-resonant frequency can be set in a high band, and attenuation characteristics with low ripple can be obtained in a wide band. It is thus possible to reduce instability of attenuation characteristics in the frequency band beyond the self-resonant frequency.

Preferably, the number of turns of the wire 21 in the second wound region Z2 is at least about three less than the number of turns of the wire 21 in the first wound region Z1 and the number of turns of the wire 21 in the third wound region Z3. More preferably, the number of turns of the wire 21 in the second wound region Z2 is about one, and the number of turns of the wire 21 in the first wound region Z1 and the number of turns of the wire 21 in the third wound region Z3 are about four. This enables attenuation characteristics with low ripple to be ensured even at around 15 GHz (in the band from about 14 GHz to about 16 GHz).

An example of the second embodiment will now be described.

In the example of the second embodiment, a hollow core of alumina was used. The core has a relative dielectric constant Er of about 10, a relative magnetic permeability μr of about 1, and a dissipation factor tan-δ of about 0. The number of turns in the second wound region Z2 is about one, and the number of turns in the first wound region Z1 and the number of turns in the third wound region Z3 are about four. In a comparative example, the wire was wound around the core about nine turns with equal pitches, and the core was not provided with more than one wound region.

Figure 6:
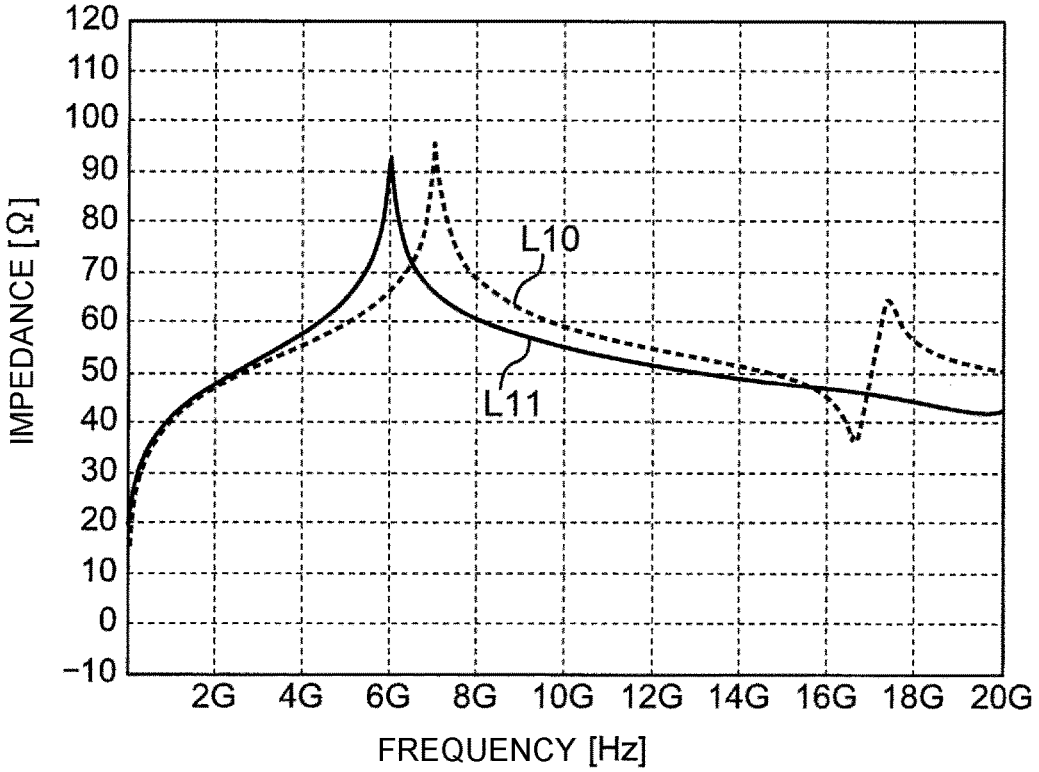
FIG. 6 is a graph showing a relation between frequency and impedance in an example of the second embodiment and a comparative example.
Figure 7:
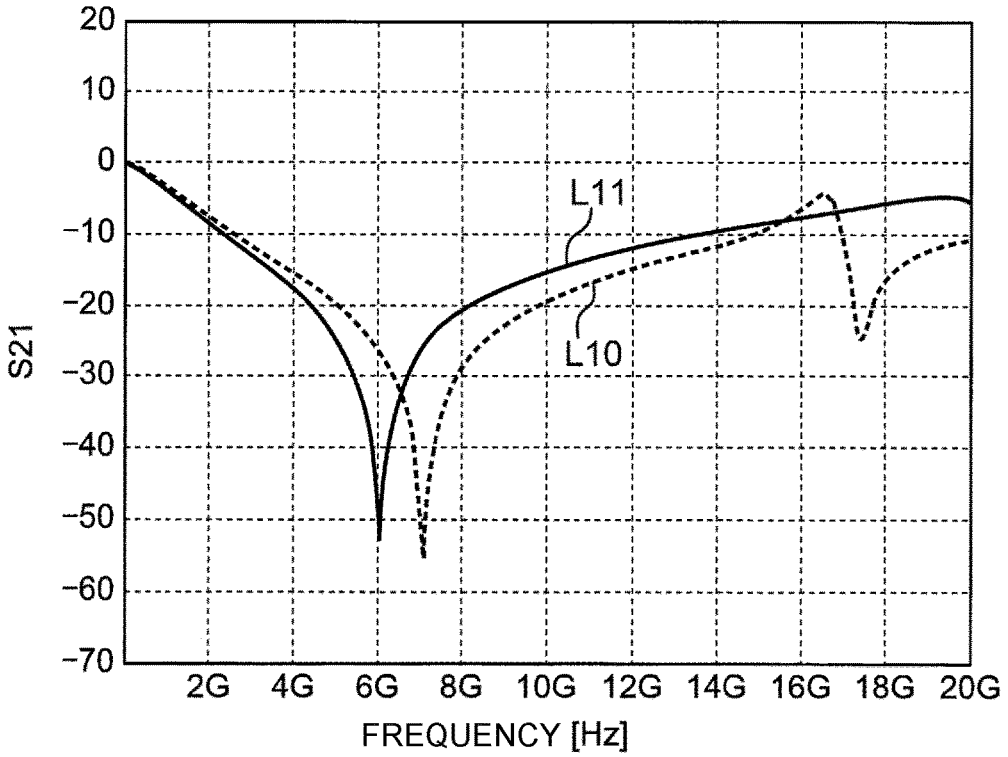
FIG. 7 is a graph showing a relation between frequency and S21 in the example of the second embodiment and the comparative example.

FIG. 6 shows a relation between frequency and impedance in the example of the second embodiment and the comparative example. FIG. 7 shows a relation between frequency and S21 in the example of the second embodiment and the comparative example. In FIG. 6 and FIG. 7, the example of the second embodiment is represented by L11 and the comparative example is represented by L10. FIG. 6 shows that in the example of the second embodiment, the anti-resonant frequency can be shifted to a frequency higher than that in the comparative example. Thus, as shown in FIG. 7, in the example of the second embodiment, attenuation characteristics with low ripple can be obtained in a wider band than in the comparative example.

The present disclosure is not limited to the embodiments described above, and design changes can be made without departing from the scope of the present disclosure. For example, features of the first and second embodiments may be variously combined.

Although only one wire is used in the embodiments, two or more wires may be connected in parallel. Although only two electrodes are used in the embodiments, three or more electrodes may be used with a center tap. Although only three wound regions are formed in the embodiments, there may be four or more wound regions, and the distance between adjacent ones of the wound regions may be any value greater than the winding pitch of the wire in each wound region.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An inductor component comprising:

a core including a winding core portion, a first collar disposed at a first end of the winding core portion in an axial direction, and a second collar disposed at a second end of the winding core portion in the axial direction;

a first electrode disposed on the first collar;

a second electrode disposed on the second collar;

a wire electrically connected to the first electrode and the second electrode and wound around the winding core portion in such a manner as to form a plurality of wound regions arranged along the axial direction of the winding core portion, such that a distance between adjacent ones of the wound regions is greater than a winding pitch of the wire in each of the wound regions; and a cover member that is disposed over an upper surface of the winding core portion without being disposed over a part of the side surfaces of the winding core portion.

2. The inductor component according to claim 1, wherein the core is a dielectric and is solid.

3. The inductor component according to claim 1, wherein the core is made of a magnetic material.

4. The inductor component according to claim 1, wherein the plurality of wound regions include a first wound region, a second wound region, and a third wound region arranged in order from the first collar toward the second collar; and a number of turns of the wire in the second wound region differs from a number of turns of the wire in the first wound region or from a number of turns of the wire in the third wound region.

5. The inductor component according to claim 4, wherein the number of turns of the wire in the second wound region is greater than each of the number of turns of the wire in the first wound region and the number of turns of the wire in the third wound region.

6. The inductor component according to claim 5, wherein the number of turns of the wire in the second wound region is at least four greater than each of the number of turns of the wire in the first wound region and the number of turns of the wire in the third wound region.

7. The inductor component according to claim 5, wherein the number of turns of the wire in the second wound region is seven, and the number of turns of the wire in the first wound region and the number of turns of the wire in the third wound region are each three.

8. The inductor component according to claim 4, wherein the number of turns of the wire in the second wound region is less than each of the number of turns of the wire in the first wound region and the number of turns of the wire in the third wound region.

9. The inductor component according to claim 8, wherein the number of turns of the wire in the second wound region is at least three less than each of the number of turns of the wire in the first wound region and the number of turns of the wire in the third wound region.

10. The inductor component according to claim 8, wherein the number of turns of the wire in the second wound region is one, and the number of turns of the wire in the first wound region and the number of turns of the wire in the third wound region are each four.

11. The inductor component according to claim 2, wherein the core is made of a magnetic material.

12. The inductor component according to claim 2, wherein the plurality of wound regions include a first wound region, a second wound region, and a third wound region arranged in order from the first collar toward the second collar; and a number of turns of the wire in the second wound region differs from a number of turns of the wire in the first wound region or from a number of turns of the wire in the third wound region.

13. The inductor component according to claim 3, wherein the plurality of wound regions include a first wound region, a second wound region, and a third wound region arranged in order from the first collar toward the second collar; and a number of turns of the wire in the second wound region differs from a number of turns of the wire in the first wound region or from a number of turns of the wire in the third wound region.

14. The inductor component according to claim 11, wherein the plurality of wound regions include a first wound region, a second wound region, and a third wound region arranged in order from the first collar toward the second collar; and a number of turns of the wire in the second wound region differs from a number of turns of the wire in the first wound region or from a number of turns of the wire in the third wound region.

15. The inductor component according to claim 12, wherein the number of turns of the wire in the second wound region is greater than each of the number of turns of the wire in the first wound region and the number of turns of the wire in the third wound region.

16. The inductor component according to claim 15, wherein the number of turns of the wire in the second wound region is at least four greater than each of the number of turns of the wire in the first wound region and the number of turns of the wire in the third wound region.

17. The inductor component according to claim 6, wherein the number of turns of the wire in the second wound region is seven, and the number of turns of the wire in the first wound region and the number of turns of the wire in the third wound region are each three.

18. The inductor component according to claim 12, wherein the number of turns of the wire in the second wound region is less than each of the number of turns of the wire in the first wound region and the number of turns of the wire in the third wound region.

19. The inductor component according to claim 18, wherein the number of turns of the wire in the second wound region is at least three less than each of the number of turns of the wire in the first wound region and the number of turns of the wire in the third wound region.

20. The inductor component according to claim 19, wherein the number of turns of the wire in the second wound region is one, and the number of turns of the wire in the first wound region and the number of turns of the wire in the third wound region are each four.

21. An inductor component comprising:

a core including a winding core portion, a first collar disposed at a first end of the winding core portion in an axial direction, and a second collar disposed at a second end of the winding core portion in the axial direction;

a first electrode disposed on the first collar;

a second electrode disposed on the second collar; and only one wire electrically connected to the first electrode and the second electrode and wound around the winding core portion in such a manner as to form a plurality of wound regions arranged along the axial direction of the winding core portion, such that a distance between adjacent ones of the wound regions is greater than a winding pitch of the wire in each of the wound regions, wherein the plurality of wound regions include a first wound region, a second wound region, and a third wound region arranged in order from the first collar toward the second collar; and a number of turns of the wire in the second wound region is greater than each of a number of turns of the wire in the first wound region and a number of turns of the wire in the third wound region.

* * * * *